US005100110A

United States Patent [19]

Alagarsamy

[11] Patent Number: 5,100,110

[45] Date of Patent: Mar. 31, 1992

[54] TREATMENT VESSEL FOR THE TREATMENT OF MOLTEN METAL MELTS

[75] Inventor: Al Alagarsamy, Milwaukee, Wis.

[73] Assignee: Georg Fischer AG, Schaffhausen, Switzerland

[21] Appl. No.: 638,450

[22] Filed: Jan. 4, 1991

[30] Foreign Application Priority Data

Jan. 5, 1990 [CH] Switzerland ..... 00037/90-8

[51] Int. Cl.[5] ..... C21B 13/00

[52] U.S. Cl. ..... 266/44; 266/216; 266/275

[58] Field of Search ..... 266/44, 216, 275

[56] References Cited

U.S. PATENT DOCUMENTS

| | | | |
|---|---|---|---|
| 4,312,668 | 1/1982 | Mannion et al. | 266/216 |
| 4,511,401 | 4/1985 | Mannion et al. | 266/216 |
| 4,666,133 | 5/1987 | Fehr et al. | 266/216 |
| 4,723,763 | 2/1988 | Defrancq et al. | 266/216 |

*Primary Examiner*—Scott Kastler
*Attorney, Agent, or Firm*—Bachman & LaPointe

[57] ABSTRACT

The present invention relates to a method and apparatus for the treatment of molten metals with a volatile treating agent and, more particularly, a method and apparatus for treating molten metal with magnesium in the form of pure magnesium or magnesium alloys.

6 Claims, 1 Drawing Sheet

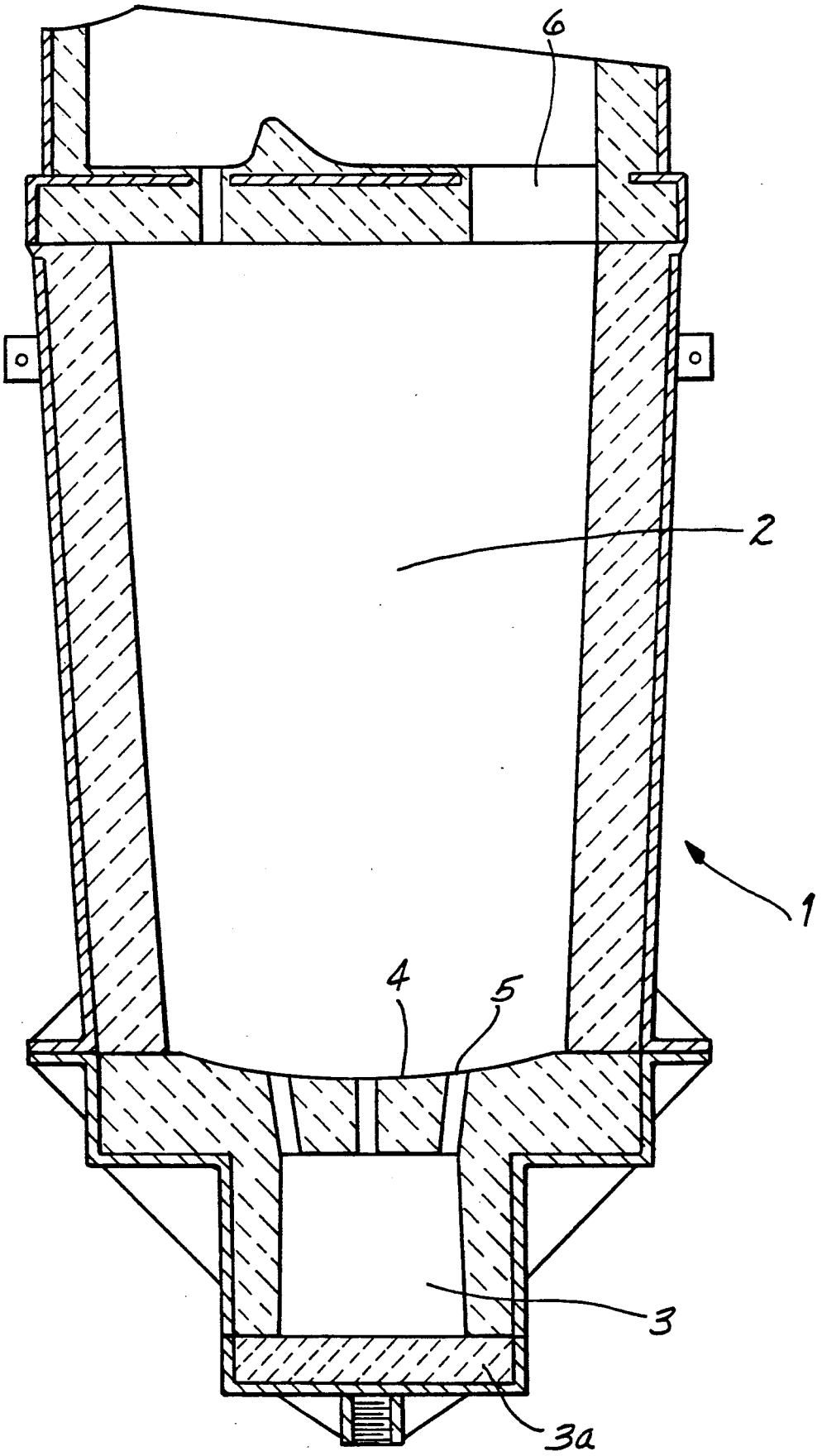
6
2
1
4
5
3
3a

TREATMENT VESSEL FOR THE TREATMENT OF MOLTEN METAL MELTS

BACKGROUND OF THE INVENTION present invention relates to a method and apparatus for the treatment of molten metals with a volatile treating agent and, more particularly, a method and apparatus for treating molten metal with magnesium in the form of pure magnesium or magnesium alloys.

The treatment of molten metal melts using pure magnesium or magnesium containing prealloys is well-known in the art. There have, however, been a number of serious disadvantages associated with known treatment methods. Specifically, when treating molten metal melts with prealloys containing low percentages of magnesium, the overall product costs are high due to their limited scope of application. In addition, during treatment, undesirable elements are brought into the melt.

One known process for treating molten metals is the "sandwich process" wherein prealloys containing low percentages of magnesium are used for the treatment of molten metal. In accordance with the process, a predetermined amount of prealloy is introduced into an open treatment vessel and subsequently molten metal is poured over the prealloy into the vessel. Due to the volatile reaction between magnesium and the molten melt, this type of process cannot be performed with prealloys which contain 40% by weight magnesium or greater.

Naturally, it would be highly desirable to provide a method and apparatus for the treatment of metal melts with magnesium which overcome the disadvantages noted above and which are economical in production and maintenance.

Accordingly, it is a principal object of the present invention to provide a process and apparatus for the treatment of molten melts with volatile treating agents.

It is a particular object of the present invention to provide a method and apparatus as aforesaid wherein molten melts may be treated with pure magnesium and prealloys containing a high percentage of magnesium.

Further objects and advantages of the present invention will appear hereinbelow.

SUMMARY OF THE INVENTION

In accordance with the present invention, the foregoing objects and advantages may be readily obtained.

The present invention is drawn to a method and apparatus for the treatment of molten metal with a volatile treating agent.

The apparatus of the present invention comprises a first chamber having a first longitudinal axis and a second chamber positioned below the first chamber and having a second longitudinal axis which, in the preferred embodiment, coincides with the longitudinal axis of the first chamber. A wall separates the first chamber from the second chamber and includes a plurality of orifices, preferably in the form of elongated passages, for communicating the first and second chambers. An inlet is provided for locating the volatile treating agent in the second chamber. A further inlet is provided for feeding the molten melt to the first chamber.

In accordance with the process of the present invention, the molten melt is fed through the first chamber in a manner which allows the molten melt to pass down through the first chamber and through the elongated passages into the second chamber wherein the melt contacts the treating agent. The total surface area of the passage means is controlled so as to insure that the molten metal slowly passes into the second chamber so as to prohibit a violent reaction. The controlled introduction of the molten metal into the second chamber allows for the use of alloys containing magnesium in amounts greater than or equal to 40 wt. % and even pure magnesium.

BRIEF DESCRIPTION OF THE DRAWINGS

The FIGURE is a cross section of a treatment vessel in accordance with the present invention.

DETAILED DESCRIPTION

The present invention is drawn to a process and apparatus for the treatment of molten metal melts with prealloys containing high percentages of magnesium and pure magnesium. The process of the present invention is especially useful for the production of cast iron containing spheroidal graphite by introducing the pure magnesium or magnesium alloy.

With reference to the FIGURE, the treatment vessel 1 comprises a first chamber 2 and a second chamber 3 provided below the first chamber. A wall 4 is provided between the first and second chambers 2 and 3, respectively. The wall is provided with a plurality of orifices 5 preferably in the form of elongated passages which communicate the first chamber 2 with the second chamber 3. The total surface area of the orifices 5 are such as to control the flow of molten metal from chamber 2 into chamber 3 in a manner to be discussed hereinbelow. The vessel 1 further includes an inlet 6 for introducing molten metal into the first chamber 2. In addition, a bottom plate **3*a* is removably fixed onto the vessel 1 so as to form an inlet for positioning the volatile treating agent into the second chamber 3**. In accordance with the present invention, the volatile treating agent is a magnesium alloy having a magnesium content of greater than or equal to 40 wt. % up to pure magnesium.

With reference to the figure, the process of the present invention will be described. Pure magnesium or a magnesium containing prealloy having a magnesium content of greater than or equal to 40 wt. % is located in the chamber 3. The introduction of the magnesium or magnesium alloy can take place when the vessel is pivoted to its horizontal position. The cover **3*a* is mounted for closing the chamber 3. The treatment vessel can then be brought to its vertical position. Subsequently molten metal is poured through the inlet 6 into the first chamber 2. The molten metal passes down through the chamber 2 and through the orifices 5 in a controlled manner into chamber 3 wherein the melt contacts the magnesium and vaporization commences. As noted above, the area of the orifices is sized so as to insure that the amount of molten metal which passes into the chamber is controlled so as to prohibit a violent reaction. As the molten metal contacts the magnesium in chamber 3 and vaporization commences, the vaporization and vaporizing pressure results in a rinsing effect which provides agitation of the melt thereby insuring that the molten metal continuously passes through chamber 3 so as to bring the reaction to completion. The reaction between the melt and the treating agent (in this case magnesium) is regulated by the continuous supply of the molten melt to the chamber as the vapor escaping from the chamber slows down the inflowing melt. In accordance with the preferred embodiment of the present invention, the direction of the longitudinal axes of the orifices 5** is provided so as to form an angle with the longitudinal axis of the treatment vessel.

The process and apparatus of the present invention will be illustrated hereinbelow with the aid of the following examples.

EXAMPLE 1

The initial melt with sulphur content of 0.011 wt. % was treated with 0.093 wt. % magnesium. After treatment the magnesium content of the melt was 0.043 wt. % and the sulphur content was reduced to 0.009 wt. %. The treating temperature was 1480° C.

EXAMPLE 2

The initial melt with sulphur content of 0.012 wt. % was treated with 0.072 wt. % magnesium. After treatment the magnesium content of the melt was 0.036 wt. % and the sulfur content was reduced to 0.009 wt. %. The treating temperature was 1510° C.

EXAMPLE 3

The initial melt with sulphur content of 0.01 wt. % was treated with 0.09 wt. % magnesium. After treatment the magnesium content of the melt was 0.042 wt. % and the sulphur content was reduced to 0.008 wt. %. The treating temperature was 1470° C.

EXAMPLE 4

The initial melt with sulphur content of 0.01 wt. % was treated with 0.23 wt. % of a prealloy containing 40% magnesium. After treatment the magnesium content of the melt was 0.048 wt. % and the sulphur content was reduced to 0.008 wt. %. The treating temperature was 1480° C.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vessel for the treatment of molten metal with a volatile treating agent comprising:

a first chamber having a first longitudinal axis;

a second chamber having a second longitudinal axis wherein said first and second longitudinal axes coincide, aid second chamber being located below said first chamber;

wall means separating said first chamber from said second chamber, said wall means including orifice means comprising a plurality of elongated passages of controlled size which lie in a plane substantially perpendicular to said first and second longitudinal axes for communicating said first chamber with said second chamber;

first inlet means for feeding said volatile treating agent to said second chamber; and second inlet means for feeding said molten metal to said first chamber wherein said molten metal passes down through said first chamber, through said plurality of elongated passages in a controlled manner and contacts said volatile treating agent in said second chamber so as to prohibit a violent treating agent in said second chamber so as to prohibit a violent reaction between said molten metal and said volatile treating agent wherein vaporization of said volatile treating agent creates a vaporizing pressure which provides agitation of said molten metal in said first chamber thereby insuring that the molten metal in said first chamber continually circulates through said second chamber until the treatment is completed.

2. A vessel according to claim 1 wherein said orifice means comprises a plurality of elongated passages each having a longitudinal axis substantially parallel to said first and second longitudinal axes.

3. A vessel according to claim 1 wherein said orifice means comprises a plurality of elongated passages each having a longitudinal axis which forms an angle with respect to said first and second longitudinal axes.

4. A method for treating of molten metal with a volatile treating agent comprising the steps of:

(a) providing a treatment vessel having a first chamber having a first longitudinal axis, a second chamber having a second longitudinal axis wherein said first and second longitudinal axes coincide, said second chamber being located below said first chamber, wall means separating said first chamber from said second chamber, said wall means including orifice means comprising a plurality of elongated passages of controlled size which lie in a plane substantially perpendicular to said first and second longitudinal axes for communicating said first chamber with said second chamber, first inlet means for feeding said volatile treating agent to said second chamber, and second inlet means for feeding said molten metal to said first chamber;

(b) locating a volatile treating agent in said second chamber; and (c) feeding molten metal to said first chamber such that said molten metal passes down through said first chamber, through said plurality of elongated passages in a controlled manner and contacts said volatile treating agent in said second chamber so as to prohibit a violent reaction between said molten metal and said volatile treating agent wherein vaporization of said volatile treating agent creates a vaporizing pressure which provides agitation of said molten metal in said first chamber thereby insuring that the molten metal in said first chamber continually circulates through said second chamber until the treatment is completed.

5. A method according to claim 4 wherein said volatile treating agent is selected from the group consisting of pure magnesium, magnesium containing alloys and mixtures thereof.

6. A method according to claim 5 wherein said molten metal comprises an iron melt.

* * * * *